US005526041A

United States Patent [19]

Glatt

[11] Patent Number: 5,526,041

[45] Date of Patent: Jun. 11, 1996

[54] RAIL-BASED CLOSED CIRCUIT T.V. SURVEILLANCE SYSTEM WITH AUTOMATIC TARGET ACQUISITION

[75] Inventor: Terry L. Glatt, Oakland Park, Fla.

[73] Assignee: Sensormatic Electronics Corporation, Deerfield Beach, Fla.

[21] Appl. No.: 302,341

[22] Filed: Sep. 7, 1994

[51] Int. Cl.[6] ..... H06N 7/18

[52] U.S. Cl. ..... 348/143; 348/155; 348/213

[58] Field of Search ..... 348/143, 144, 348/151, 152, 155, 207, 211, 213; H04N 7/18

[56] References Cited

U.S. PATENT DOCUMENTS

| | | | |
|---|---|---|---|
| 3,935,380 | 1/1976 | Coutta | 348/150 |
| 4,027,329 | 5/1977 | Coutta | 348/150 |
| 4,326,218 | 4/1982 | Coutta et al. | 348/150 |
| 4,337,482 | 6/1982 | Coutta | 348/159 |
| 4,510,526 | 4/1985 | Coutta et al. | 348/143 |
| 4,644,845 | 2/1987 | Garehime | 348/143 |
| 5,018,009 | 5/1991 | Koerv | 348/211 |
| 5,109,278 | 4/1992 | Erickson | 348/207 |
| 5,225,863 | 7/1993 | Weir-Jones | 348/211 |
| 5,241,380 | 8/1993 | Benson | 348/143 |
| 5,327,233 | 7/1994 | Choi | 348/152 |

*Primary Examiner*—Howard W. Britton

*Attorney, Agent, or Firm*—Robin, Blecker, Daley & Driscoll

[57] ABSTRACT

In a rail-based closed-circuit TV surveillance system, initialization is performed by positioning the surveillance camera at two different positions along the rail from which a target image is acquired. Camera direction parameters for each of the positions are stored. From the stored parameters there is calculated an optimum position for target acquisition. A normal surveillance routine is interrupted in response to an alarm signal. If the camera is within a range for viewing the target, target acquisition occurs immediately while the camera is moved toward the optimum position. If the camera is not within the range for viewing the target, the camera is moved toward the viewing range, while camera direction and focus are adjusted so that target acquisition occurs as soon as the camera reaches the viewing range. Camera direction and focus continue to be adjusted so that a target acquisition is maintained while the camera is moved within the viewing range toward the optimum position.

28 Claims, 5 Drawing Sheets

RAIL-BASED CLOSED CIRCUIT T.V. SURVEILLANCE SYSTEM WITH AUTOMATIC TARGET ACQUISITION

FIELD OF THE INVENTION

This invention relates generally to closed-circuit television surveillance systems and pertains more particularly to such systems in which a television camera is mounted on a carriage for movement along a rail or track, and in which the system is subject to automatic control by a computer or the like.

BACKGROUND OF THE INVENTION

It is known to provide closed circuit television surveillance systems using either cameras in a fixed location or cameras that are mounted for movement along a rail or track. It is also known, in the case of a system using a fixed-position camera, to provide automatic acquisition of a fixed target object in response to an alarm signal or the like. For example, a target object such as a door can be equipped with a sensor which provides an alarm signal to a central control portion of the surveillance system when the door is opened. Assuming that data has previously been stored in the control system to indicate the required direction of view and appropriate zoom and/or focus condition for the camera to provide an image of the target door, the control system can implement an immediate adjustment to the camera direction, zoom condition, etc. so that an image of the door is provided by the camera within a very short time after the door is opened.

However, when the system utilizes a moving camera, such as a camera mounted on a carriage which travels along a rail, the camera may be located at any arbitrary position in its range of movement at the time an alarm is received. Since the camera location at the time of the alarm cannot be known in advance, it is not possible to store in advance data defining a particular direction and zoom condition of the camera which will enable the camera to provide an image of the target from the position of the camera at the time of the alarm.

In the case of an operator-attended surveillance system, the human operator may attempt to respond to the alarm signal by operating system controls to reposition the camera carriage and to adjust the camera direction, etc. so that an image of the target object is obtained. However, the variety of possible camera positions and directions-of-view may lead to disorientation on the part of the operator. Also, if the system is set up with multiple target objects (e.g., multiple doors, windows, cabinets and so forth) for which alarms may be actuated, the operator may have difficulty identifying the particular target to which the alarm pertains. As a result, the human operator's response to the alarm may be too slow to capture an image of the event (such as entry of an intruder) which caused the alarm.

While it might be proposed to define a predetermined position along the track to which the camera should be moved in response to an alarm which pertains to a particular target, and then an appropriate direction of view and zoom condition data could also be stored for providing an image of the target from that predetermined position, such an approach carries the disadvantage that a significant amount of time may be required to move the carriage to the predetermined position from the position of the carriage at the time the alarm is received. Even if automatic camera direction and zoom adjustments are performed before or during carriage movement so that the camera will be in an appropriate orientation and zoom condition to provide the image of the target as soon as the predetermined carriage position is reached, still target acquisition cannot take place during the time the carriage is in motion, and target acquisition thus may be substantially delayed.

SUMMARY OF THE INVENTION

The present intention has as its primary object the provision of a closed circuit television surveillance system, using a rail-based television camera, that is capable of acquiring an image of a fixed target within a minimum amount of time after receipt of an alarm signal or the like.

Another object of the invention is provision of a surveillance system using a rail-mounted camera in which the camera is controlled to continuously track a target while the camera is moving along the rail.

In attaining the foregoing and other objects, the invention provides a method of operating a rail-based closed-circuit television surveillance system wherein the system includes an elongated track positioned along a path, a carriage supported and movable along the track for transporting a television camera along the path, carriage moving means coupled to the carriage for selectively moving the carriage along the track, camera control means for selectively adjusting a direction of view and a zoom condition of the television camera, and carriage control means for selectively positioning the carriage along the track, and wherein the method includes the steps of initializing the system by capturing an image of a predetermined target object by means of the television camera at respective times when the camera is at two different selected points along the track and storing initialization data indicative of the selected points and the respective directions of view of the camera used for capturing the target object image at the selected points; calculating from the stored initialization data an optimum viewpoint along the track for capturing an image of the predetermined target object and an optimum pan angle, an optimum tilt angle and an optimum zoom condition for capturing the image of the predetermined target object when the camera is at the optimum viewpoint; receiving a target acquisition signal; and moving the carriage to the optimum viewpoint in response to the target acquisition signal.

According to an aspect of the invention, the direction of view of the camera is continuously adjusted while the carriage is moved from one of the two selected points to the optimum point so that the direction of view of-the camera remains oriented towards the target object during the movement of the carriage from the one of the two selected points to the optimum point.

It is desirable that the optimum viewpoint be between the selected points used during initialization and that the optimum viewpoint be the closest point along the track to the target object.

In other practice in accordance with the invention, if the target acquisition signal is received at a time when the carriage is not between the two selected points, the carriage is moved toward the closer of the two points and the direction of view of the camera is adjusted, while the carriage is being moved toward the closer of the two selected points, so that the camera has the same direction of view that was used during the initialization to capture the image of the predetermined target object from the closer of the two selected points.

It is also contemplated by the invention that the carriage be reciprocated between the two selected points in response to the target acquisition signal and that the direction of view of the camera be continuously adjusted so that the direction of view of the camera remains oriented towards the target object during the reciprocating movement of the carriage.

The foregoing and other objects and features of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
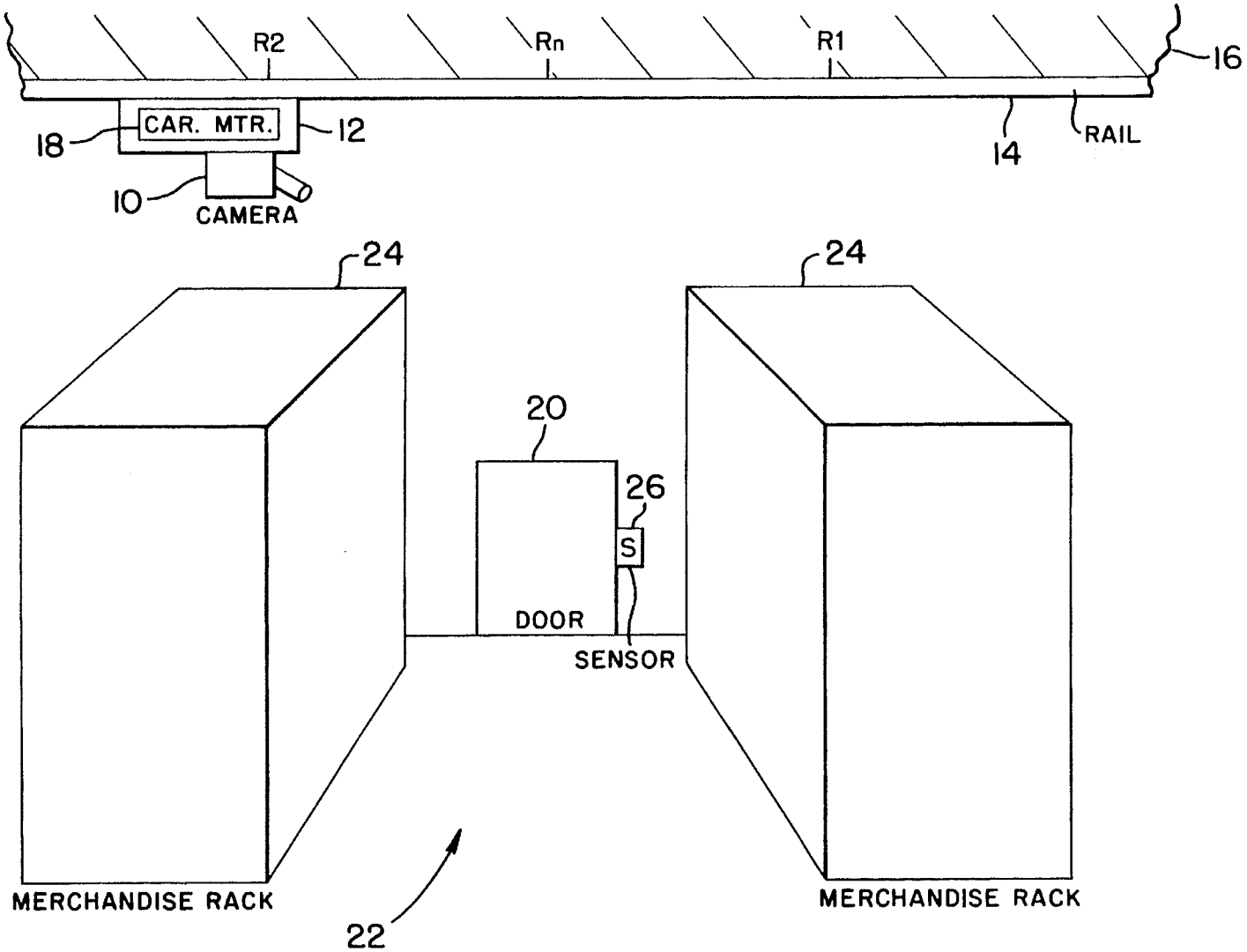
FIG. 1 is a perspective view of a closed-circuit television surveillance system, using a rail mounted camera, in which the present invention may be applied.

FIG. 1 shows the interior of a building in which there is installed a surveillance system in accordance with the present invention. The system includes a surveillance camera 10 that is mounted on a carriage 12. The carriage 12, in turn, is movably supported on an elongated track or rail 14, which is suspended from the ceiling 16 of the building.

The camera 10 may be of a conventional type which is subject to remote control as to the direction in which the camera is oriented. In particular, the camera is controllable for horizontal pivoting movement, known as "panning", as well as vertical pivoting movement known as "tilting". Alternatively, as will be recognized by those skilled in the art, a motorized mirror assembly may be mounted on the carriage in association with the camera 10 for accomplishing tilting and panning adjustments of the direction of view of the camera.

The carriage 12 includes a motor 18 which is also subject to remote control by the surveillance system. Appropriate encoding such as optical encoding (not shown) is provided along the rail 14 so that the position of the carriage 12 along the rail can be sensed and an appropriate carriage position signal provided to the control system. Alternatively, other techniques may be employed to determine the position of the carriage, such as detecting operation of motor 18. Thus, the carriage can be controllably moved to desired positions along the rail 14. It should be understood that connections for controlling the camera 10 and the carriage 12 can be via cable (in which case a cable reel carriage may be provided integrated with or separate from camera carriage 12) or by wireless communication links.

Although not shown in FIG. 1, it will be recognized that an opaque cover or the like for hiding the camera 10 may be provided surrounding the rail 14 and the path of travel of the carriage 12.

The building interior shown in FIG. 1 includes a door 20 located at the end of an aisle 22 formed between racks or tiers 24 of merchandise or the like. A sensor 26 is installed in proximity to the door 20 and provides an alarm signal when, for example, the door is opened.

Figure 2:
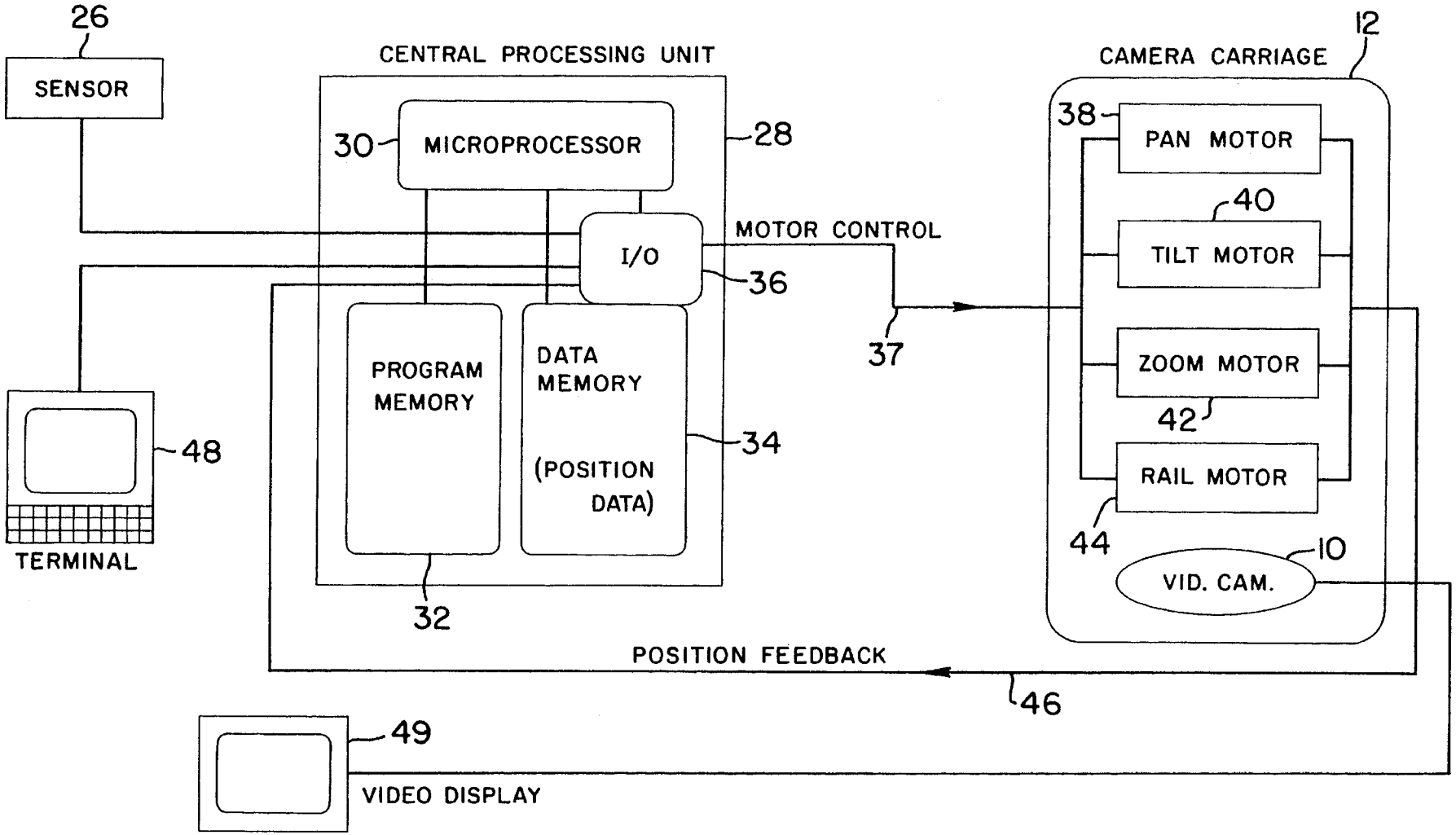
FIG. 2 is a block diagram of a surveillance system in accordance with the invention.

FIG. 2 illustrates the surveillance system of the present invention in block diagram form. At the heart of the system is a central processing unit (CPU) 28, which includes a microprocessor 30. Associated with the microprocessor 30 are a program memory 32, for storing control software, and a data memory 34 in which working data are stored, including, as will be seen, parameter data collected during an initialization routine. CPU 28 also includes an input/output (I/O) module 36 which is connected to microprocessor 30 and provides an interface between the CPU 28 and other portions of the surveillance system.

In particular, I/O module 36 is connected by way of a signal path 37 to a pan motor 38, a tilt motor 40, a zoom motor 42 and a rail motor 44. Pan motor 38 provides the above-mentioned panning adjustments for the video camera 10, tilt motor 40 provides the above-mentioned tilt adjustments of the video camera 10, zoom motor 42 implements changes in the zoom condition of the camera 10, and rail or carriage motor 44 propels the carriage 12 along the rail 14. Each of these motors receives control signals from the CPU 28 by way of the I/O module 36 and the signal path 37, and all of these motors are carried on the carriage 12 (although, as an alternative, the carriage 12 may be driven by an off-board motor through a belt drive or the like). It should also be understood that each of the motors 38, 40, 42, and 44 are arranged to provide position feedback signals indicative of the position of the motor or of the carriage, as the case may be. These signals are transmitted back to the CPU 28 by way of a signal path 46 and I/O module 36. The paths 37 and 46 may, for example, be embodied by appropriate cabling, or wireless data channels, etc.

Also connected to CPU 28 by way of I/O module 36 are a user terminal 48 and the above-mentioned sensor 26. The terminal 48 permits a human operator to input data to the CPU 28 in a conventional manner, and also permits the CPU 28 to display data to the human operator in a conventional manner. Also, the I/O module 36 is provided with a communication channel from the sensor 26 for receiving therefrom the above-mentioned alarm signal, upon opening of the door 20 (FIG. 1).

It should also be understood that the surveillance system shown in FIG. 2 provides the customary capabilities for remote control of the camera 10 and carriage 12 by the human operator, including selective positioning of the carriage 12, and panning, tilting and zooming of the camera 10, all by way of signals input via the terminal 48.

The surveillance system also includes a video display monitor 49 connected (or linked by wireless channel) to receive and display the video output signal provided by the camera 10. Although display 49 is shown as being separate from terminal 48, it is also contemplated to share a monitor portion of terminal 48 with display 49, by means of split screen, windowing, time sharing, superposition of a cursor and characters on the video display, and so forth.

Referring again to FIG. 1, it will be assumed that the rail 14, door 20 and merchandise tiers 24 are positioned with respect to each other so that the door 20 is within a line of sight of the camera 10 over a portion of the rail 12, but when the carriage 12 is positioned outside of that portion of the rail 14, the line of sight from the camera 10 to the door 20 is occluded by, for example, the tiers of merchandise 24. It is also assumed for the purposes of the following discussion that the door 20 is a target for which automatic image acquisition is desired. Accordingly, there will first be described an initialization procedure during which appropriate data is stored in the CPU 28 to allow for an automatic target acquisition operation in accordance with the invention.

Figure 3A:
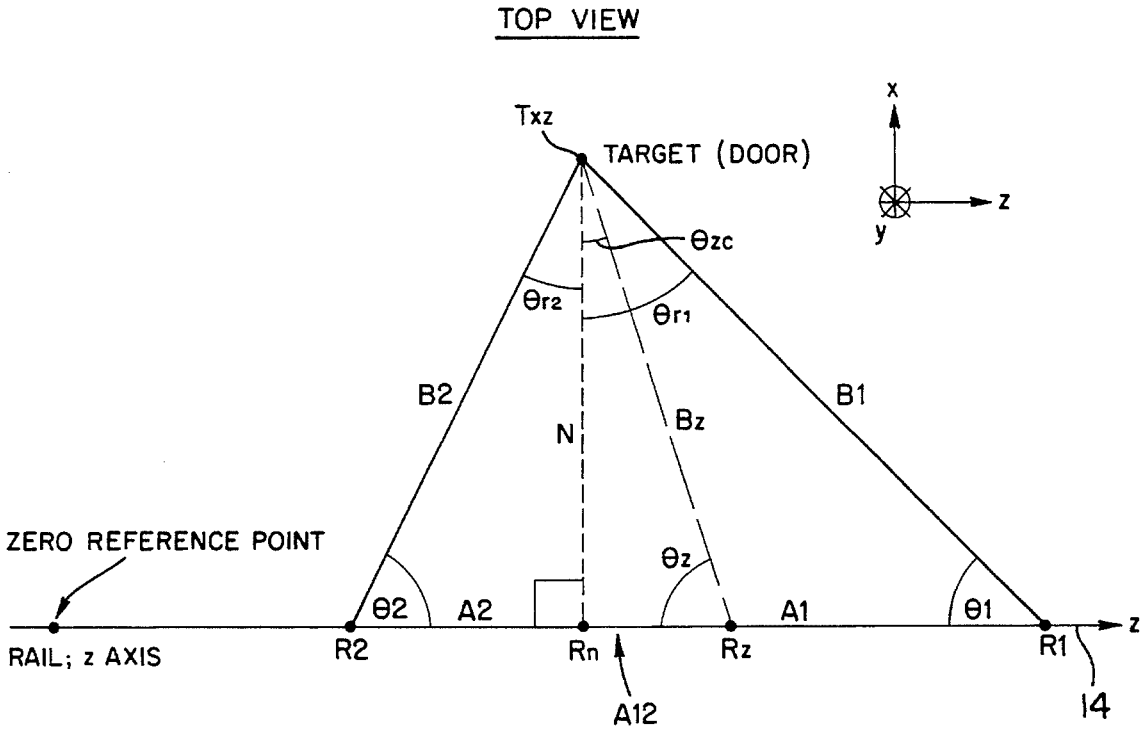
FIGS. 3A and 3B are respectively top and back isometric schematic diagrams used for explaining initialization and automatic target acquisition procedures carried out in accordance with the invention.
Figure 3B:
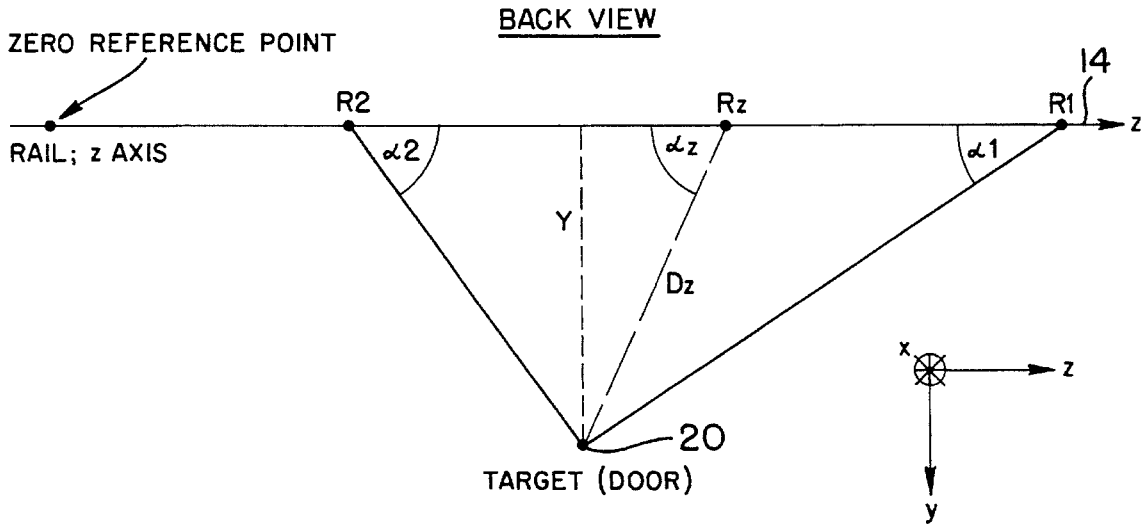

In describing the initialization procedure, reference will be made to FIGS. 3A and 3B, which are respectively top and back diagrammatic views which illustrate geometric relationships among a target (assumed to be door 20), the rail 14 (taken to be the "z-axis"), and various positions along rail 14 at which the carriage 12 may be located. In the coordinate system used in FIGS. 3A and 3B, the x-axis direction is taken to be the horizontal direction perpendicular to the rail 14, and the y-axis direction is taken to be the vertical direction. In addition, the horizontal plane which passes through the rail 14 will be referred to as the x-z plane, while the vertical plane which passes through rail 14 will be referred to as the y-z plane.

Point R1 corresponds to a right-most position on the rail 14 from which there is a line of sight to the target door 20, and point R2 corresponds to the left-most position on the rail 14 from which there is a line of sight to the target door 20. As seen from FIGS. 3A and 3B, a zero-reference or origin point is taken to be at a leftward position along the rail(z-axis), so that the position index of R1 is larger than the position index of R2. Further, point Rn represents a position on the rail 14 that is closest to the target 20, and Rz indicates an arbitrary position between points R2 and R1 at which the carriage 12 and camera 10 may be located at any given time. It should also be understood that the system is arranged so that the camera 12 may at some times be at positions along rail 14 that are outside of the range defined between point R2 and R1. Further, and referring particularly to FIG. 3A, the line B1 represents the projection on the x-z plane of the line of sight from point R1 to the target, and, similarly, the line B2 represents the projection on the x-z plane of the line of sight from point R2 to the target. The dashed line Bz similarly represents the projection on the x-z plane of the line of sight from the arbitrary point Rz to the target, and the dotted line N represents the projection on the x-z plane of the line of sight from the point Rn to the target. The line segment A2 is defined between the points R2 and Rn, and the line segment A1 is defined between points Rn and R1. In addition, the line segment A12 is defined between the points Rn and Rz. The point Txz is located in the x-z plane directly above the target.

Moreover, the angle θ1 between line B1 and the z axis represents the required pan angle for the camera to acquire the target when the carriage is located at point R1, while the angle θ2 between the line B2 and the z axis represents the appropriate pan angle for the camera to acquire the target when the carriage is located at the point R2. Similarly, the angle θz formed between the line Bz and the z axis represents the appropriate pan angle for acquiring the target when the camera is located at point $R_z$, Reference to FIG. 3B will indicate that the appropriate camera tilt angles for target acquisition from points R2, Rz and R1 are schematically represented by the angles α2, $\alpha_z$ and α1. It will also be noted from FIG. 3B that the line Dz represents the line of sight from point Rz to the target (not a projection), while the dotted line Y is the projection on the y-z plane of a normal line from the z axis to the target. Thus Y represents the vertical distance between the target and the x-z plane.

Continuing to refer to FIGS. 3A and 3B, and also now making reference to FIG. 4, there will be described an initialization routine to be carried out in accordance with the invention for enabling the surveillance system to perform automatic target acquisition.

Figure 4:
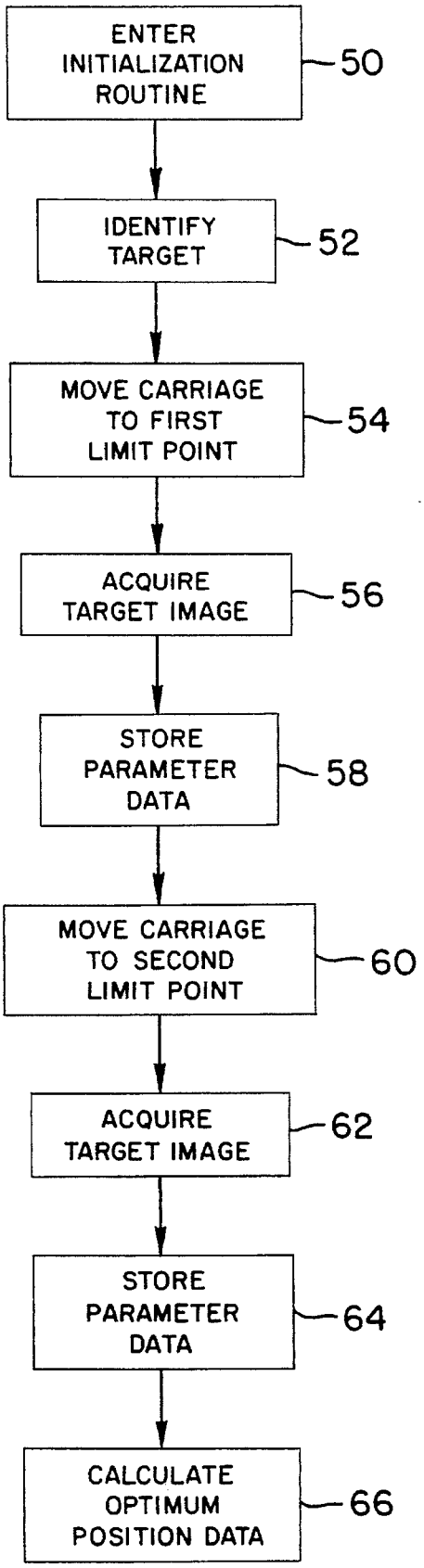
FIG. 4 is a flow chart of an initialization routine carried out in accordance with the invention.

As shown in FIG. 4, the initialization procedure is commenced at step 50 by entry of an appropriate signal via user terminal 48 so that the microprocessor 30 begins to carry out an initialization routine.

Following step 50 is step 52, at which appropriate data entry is made to identify the target for purposes of future reference within the surveillance system. For example, an appropriate prompt may be displayed on the terminal 48, and in response thereto the operator may enter a designation such as "target No. 1". In other words, the target object for which initialization data is about to be issued will thereafter be referred to within the surveillance system as "target No. 1" and a sensor or sensors associated with that target object will accordingly be recognized by the surveillance system as providing an alarm signal with respect to the identified target object. It is also contemplated that an alarm signal can be actuated with respect to a particular target by an appropriate operator input via the terminal 48. It will be understood that this arrangement permits the surveillance system to provide automatic acquisition for plural targets in response to respective alarm signals pertaining to the targets.

The next step in the initialization .routine is step 54, at which the terminal 48 is operated so that the carriage is moved to the point at the end (for example at the right end) of a range of positions along the rail 14 from which the target object may be acquired by the camera 10. For the purposes of this example, that point will be identified as R1. For example, such a point may be a short distance to the right of aisle 22 as shown in FIG. 1. Once step 54 has been accomplished, step 56 is carried out, in which the operator causes the camera's direction of view to be adjusted, and perhaps also adjusts the zoom and focus condition of the camera, so that the target object (door 20) is imaged by the camera 10. When a satisfactory image of the target door 20 has been acquired through the camera 10, the human operator then enters a "select" signal or the like, in response to which the surveillance system stores in data memory 34 data which represents the current position (now assumed to be R1) of the carriage 12, as well as data indicating the pan and tilt angles of the direction of view of the camera 10 (step 58).

Following step 58 is step 60, at which the human operator moves the carriage 12 to the other end of the range from which there is a line of sight to the target door 20. In this case it is assumed that the other end is the left-most end of the viewable range, at point R2.

When the carriage has been properly positioned at R2, the operator again causes the camera direction and zoom/focus conditions to be adjusted so that a satisfactory image of the target door 20 is obtained (step 62). Then, at step 64, again the "select" signal is entered via the terminal 48 so that the data representing the carriage position, as well as the camera direction (pan and tilt angles) is entered into the data memory 34.

Step 66 follows, at which the position of point Rn is calculated on the basis of the data stored during steps 58 and 64. As noted before, point Rn is assumed to be the optimum point for acquiring an image of the target 20, namely the closest position to the target along rail 14.

This calculation begins by determining the values for angles for $\theta_{T1}$ and $\theta_{T2}$ (FIG. 3A) which are respectively complimentary angles to θ1 and θ2. Thus, calculations are made according to the following formulas:

$$\theta_{T1}=90°-\theta 1 \quad (1)$$

$$\theta_{T2}=90°-\theta 2. \quad (2)$$

Then a parameter k is calculated according to the formula $$k=\frac{\tan\Theta_{T1}}{\tan\Theta_{T2}} \quad (3)$$

It will be recognized that the parameter k is equal to the ratio of the lengths of the line segments A1 and A2; that is, $$k=\frac{A1}{A2} \quad (4)$$

Next the distance Z between the points R1 and R2 is calculated according to:

$$Z=R1-R2. \quad (5)$$

Since $$Z=A1+A2 \quad (6)$$

the simultaneous equations (4) and (6) can be solved to express A1 and A2 in terms of k and Z as follows:

$$A1=\frac{kZ}{1+k} \quad (7)$$

$$A2=Z\left(1-\frac{k}{1+k}\right) \quad (8)$$

Then Rn can be calculated either as (R1–A1) or (R2+A2). Step 66 may be considered complete upon calculation of the position of the optimum viewpoint Rn.

As will be seen, the calculated position of Rn, together with the stored data indicative of the locations and the appropriate pan and tilt angles for the points R2 and R1, make it possible to calculate an appropriate camera direction (pan and tilt angles) as well as appropriate zoom and focus conditions for target acquisition from any carriage position between points R2 and R1. It will be understood that the zoom and focus conditions are a function of the distance from the carriage position to the target, and this quantity can be calculated based on the stored data.

There will now be described, with reference to FIG. 5, an operation in which the surveillance system automatically acquires an image of the target on the basis of the data stored and calculated during the initialization procedure of FIG. 4.

Figure 5:
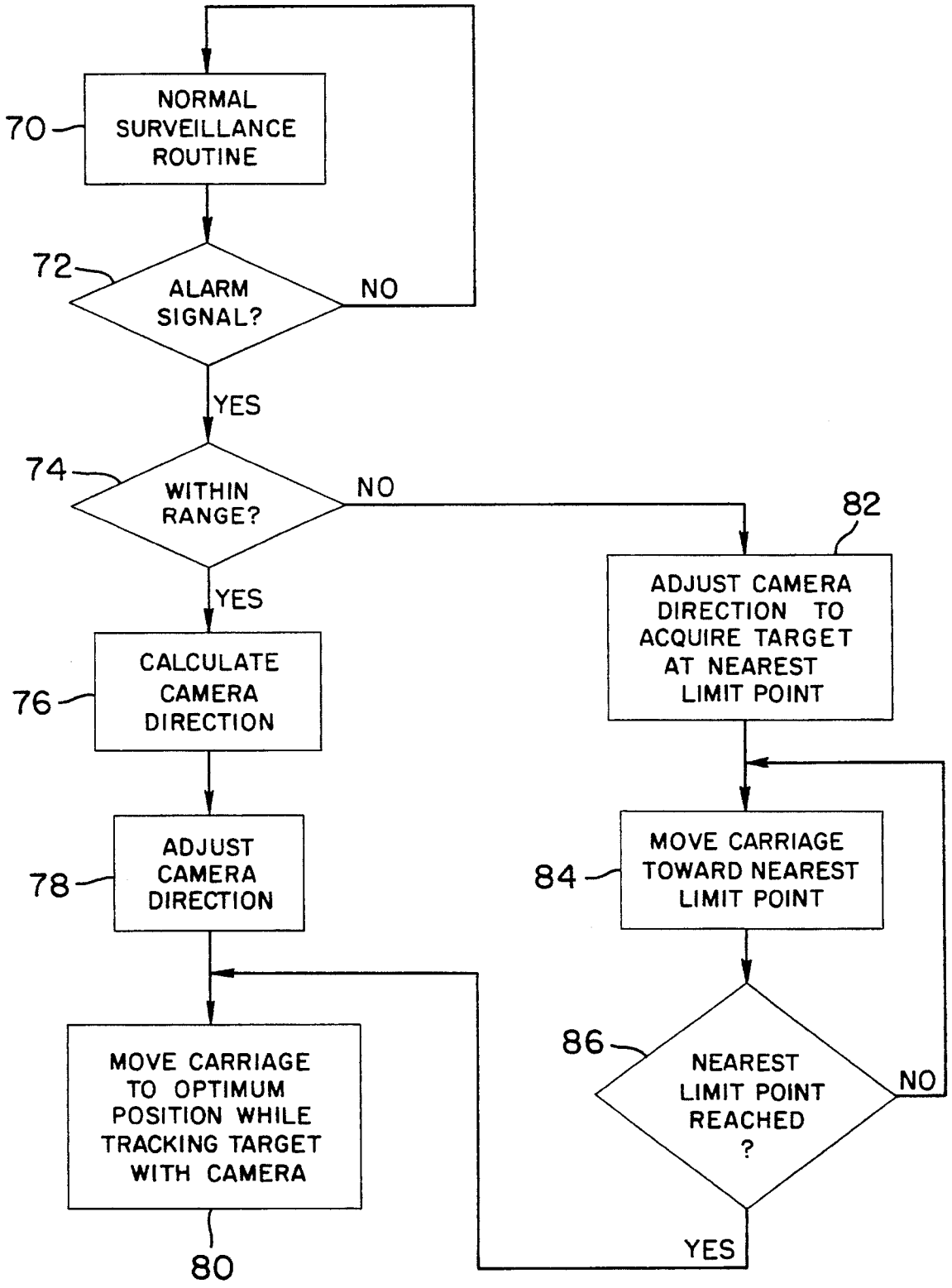
FIG. 5 is a flow chart of a routine carried out in accordance with the invention for automatically acquiring a target in response to an alarm signal.

It is assumed that the automatic target acquisition routine is entered from a normal surveillance routine, represented by a step 70 in FIG. 5. Specifically, it should be understood that step 70 may include an automatically controlled procedure in which the carriage 12 is moved along rail 14 according to a predetermined pattern, while the direction, zoom, focus and so forth of the camera 10 are also adjusted in a predetermined pattern so that camera 10 performs routine surveillance by "walking a beat."

As indicated at step 72, the normal surveillance routine 70 continues until an alarm signal is received. Step 72 may be implemented by applying an interrupt to microprocessor 30 upon receipt of an alarm signal. Alternatively, for example, periodic polling may be carried out during normal surveillance to detect the presence of an alarm signal. If an alarm signal is received, it is then determined whether the carriage 12 is located within a range along the rail 14 from which there is a line of sight to the target (step 74). It will be assumed in the present case, initially, that an alarm signal has been generated by the sensor 26 associated with the door 20 ("target No. 1") and that the carriage 12 is at a point Rz (FIGS. 3A and 3B) that is between points R1 and R2, and thus is within the range from which the target 20 can be acquired by the camera 10. In accordance with this assumption, step 76 follows step 74, and in step 76 the surveillance system (CPU 28) calculates an appropriate pan angle, tilt angle, zoom condition and focus condition for the camera 10 so that an image of target 20 can be immediately provided on the video display 49.

First the calculation of the pan angle θz will be described with reference to FIG. 3A. Using the common side of the triangles Rn/R1/Txz and Rn/Rz/Txz, the following equation can be obtained:

$$\frac{A1}{\tan\theta_{T1}}=\frac{A12}{\tan\theta_{zc}} \quad (9)$$

where θzc is the complimentary angle to θz.

This equation can be rewritten as $$\tan\theta_{zc}=\frac{A12}{A1}(\tan\theta_{T1}) \quad (10)$$

Since $$\theta_z=90°-\theta_{zc}$$

it follows from equation 10 that the pan angle θz can be calculated as follows:

$$\Theta_z=90°-\tan^{-1}\left[\left(\frac{A12}{A1}\right)\tan\Theta_{T1}\right] \quad (11)$$

From equation 11, it will be recognized that the pan angle θz can be readily calculated from the initialization data and the current position Rz.

Alternatively, θz can be calculated according to the following equation:

$$\Theta_z=\tan^{-1}\left(\frac{A1\cdot\tan\Theta 1}{A12}\right) \quad (11A)$$

which can be obtained from, $$N=A1\cdot\tan\theta 1 \quad (11B)$$

and $$\Theta_z=\tan^{-1}\left(\frac{N}{A12}\right) \quad (11C)$$

In order to find the tilt angle $\theta_z$ (FIG. 3B), the vertical distance Y between the target and the x-z plane is first calculated according to the formula:

$$Y=\left(\frac{A1}{\cos\Theta 1}\right)\tan\alpha 1 \quad (12)$$

(As an alternative to calculating Y during automatic target acquisition, Y may be calculated at step 66 of the initialization routine (FIG. 4).)

Then $\theta_z$ is determined according to:

$$\alpha_z=\tan^{-1}\left(\frac{Y\cos\Theta_z}{A12}\right)=\tan^{-1}\left(\frac{Y}{B_z}\right) \quad (13)$$

Next, in order to determine the appropriate zoom and focus conditions for the camera 10, the distance Dz from the point Rz to the target along the line of sight from point Rz for the target is calculated.

First it will be noted that $$\cos\alpha_z=\frac{B_z}{D_{zo}} \quad (14)$$

so that $$D_z = \frac{B_z}{\cos \alpha_z} \tag{15}$$

Then, substituting for $\alpha z$ (from equation 13), and expanding, yields:

$$D_z = \frac{B_z}{\cos\left\{\tan^{-1}\left[\frac{\left(\frac{A1}{\cos\theta 1}\right)\cdot(\tan\alpha_1)\cdot(\cos\theta z)}{A1-(R1-R_z)}\right]\right\}} \tag{16}$$

Then, since Bz=A12/cos θz,
substituting in equation 16, provides $$D_z = \frac{A12}{\cos\left\{\tan^{-1}\left[\frac{\left(\frac{A1}{\cos\theta 1}\right)\cdot(\tan\alpha_1)\cdot(\cos\theta z)}{A1-(R1-R_z)}\right]\right\}\cos\theta z} \tag{17}$$

Thus it is seen that the distance to the target from the current position of the camera 10 can be expressed in terms of the current position of the carriage 12 and other data that has previously been stored or calculated. Accordingly, at step 78, which follows step 76, the direction of view of the camera adjusted in accordance with the calculated pan and tilt angles, and the appropriate zoom and focus conditions are applied so that the camera 10 provides an image of the target door 20. Then step 80 follows step 78, so that the carriage 12 is moved from the point Rz, at which the carriage was located when the alarm was received, to the optimum viewpoint Rn. Also, while this carriage movement is taking place, the pan angle, the tilt angle, the zoom condition and the focus condition are continuously updated, by calculations as described above, so that the camera continues to "track" the target; that is, the camera continuously provides an image of the target while the carriage is in motion from point Rz to point Rn.

As will be recognized by those of ordinary skill in the art, the above described calculations and adjustments to the camera direction, zoom condition, etc. are performed quite rapidly relative to the motion of the carriage, which makes possible the continuous tracking of the target by the camera. Of course, it is also possible to overlap in time the logically separate operations described above with respect to steps 76, 78 and 80.

Returning now to decision step 74, let it be assumed that, at the time the alarm signal was received, the carriage 12 was positioned outside of the range defined by points R2 and R1, and, more specifically, assume that the carriage 12 was located to the right of point R1.

In that case, it is determined at step 74 that the carriage 12 is not within the range from which the target can be acquired, and step 82 therefore follows step 74. At step 82, it is first determined whether the carriage 12 is closer to point R1 or point R2, and then the pan and tilt angles and the zoom and focus conditions for the camera are established in accordance with the previously stored parameters appropriate for that nearest point. Since, according to the present assumption, R1 is the nearest of the two points, the camera is adjusted to have a pan angle θ1 and a tilt angle $\alpha_1$. It will also be recognized that the appropriate camera focus and zoom conditions for the two limit points R1 and R2 can either be stored as part of the initialization procedure or can be calculated from other data obtained during initialization.

Following step 82 is step 84, at which the carriage 12 is moved toward the nearest limit point, in this case R1. Because the camera has already been adjusted so as to assume the appropriate pan and tilt, etc. for point R1, it will be understood that the target will be acquired immediately when the carriage reaches point R1.

Following step 84 is a decision step 86, at which it is determined whether the nearest limit point has been reached. If not, the routine loops back to step 84. Otherwise, the routine proceeds to step 80, at which the carriage is moved from the limit point to optimum position Rn while providing continuous tracking of the target by the camera 10.

It should also be noted that although steps 82 and 84 are presented as logically separate, those two steps can be overlapped in time so that the camera angle adjustment is carried out during movement of the carriage 12 toward the nearest point.

The above description of steps 76 and 80 referred to calculations carried out to Obtain pan, tilt, zoom and focus data for immediate target acquisition in response to an alarm (step 76) or during carriage movement (step 80) to update the pan and tilt angles and the zoom and focus conditions so that target acquisition was maintained during the carriage movement within the viewing range. However, according to an alternative preferred practice, pan, tilt, zoom and focus data are retrieved for target acquisition from a look up table that was formed during initialization. More specifically, according to this preferred practice, step 66 of the initialization procedure (FIG. 4) includes calculating, for each separately detectable carriage position in the target viewing range, appropriate pan, tilt, zoom and focus parameters for target acquisition. The resulting data is stored in a look up table for the target, and indexed in the table according to carriage position. The parameters stored in the look up table entries for the limit points are, of course, those obtained at steps 58 and 64. Then, during the target acquisition routine of FIG. 5, access is had to the look up table corresponding to the target to be acquired, and camera positioning and focus and zoom data are read out based on the current carriage position. If the current carriage position is outside of the viewing range for the target, the camera positioning data corresponding to the nearest position in the viewing range (i.e., the nearest limit point) is read out.

According to an alternative technique for practicing the invention, the procedure described with respect to step 80 can be changed, or selectively changed, so that the carriage 12 is caused to reciprocate or "pace" back and forth between the points R1 and R2 in response to receipt of an alarm signal. While such "pacing" takes place, calculations as described above are carried out (or positioning data is retrieved from a look up table) so that the camera continuously tracks the target. The "pacing" may also be arranged to be performed over less than the entire range from which a line of sight exists. It is also contemplated that the carriage be moved, in response to an alarm, according to more complex patterns than simple pacing between two points in the viewing range. For example, the system could be programmed during initialization so that, in response to an alarm, the carriage first paces a predetermined number of times between the optimum viewpoint and the right limit point, and then paces a predetermined number of times between the optimum viewpoint and the left limit point, and then paces again between the optimum viewpoint and the right limit point, and so forth. As an alternative "beat" that could be programmed to be "walked" in response to an alarm, the carriage could be reciprocated several times over a narrow range around the optimum point, then over a wider range around the optimum point, and then over a still wider range. Other variations and permutations of such programmed responses to an alarm will readily occur to those who are skilled in the art.

Further, although the above-described practice of the invention entails calculating the location of a closest point Rn to the target to provide an optimum viewpoint, it is possible as an alternative to manually set the desired optimum viewpoint during initialization. For example, if some obstruction happens to block the line of sight from the closest point Rn to the target, a different point can be manually selected and appropriate pan, tilt and zoom data stored.

It should also be understood that an alarm signal can be generated from a source other than a sensor. For example, an alarm signal can be actuated by appropriate operator input via terminal 48 in a circumstance in which the operator wishes to obtain rapid and automatic acquisition of a particular target.

Various changes to the foregoing surveillance system and modifications in the described practices may be introduced without departing from the invention. The particularly preferred methods and apparatus are thus intended in an illustrative and not limiting sense. The true spirit and scope of the invention is set forth in the following claims.

What is claimed is:

1. A surveillance system comprising:

an elongated track positioned along a path;

carriage means supported on and movable along said track for transporting a television camera along said path;

carriage moving means coupled to said carriage means for selectively moving said carriage means along said track;

means associated with said television camera and responsive to camera control signals for selectively adjusting a direction of view and a zoom condition of said television camera;

carriage control means coupled to said carriage moving means and responsive to carriage control signals for selectively positioning said carriage means along said track; and initialization means for entering first and second sets of initialization parameters, said first set of initialization parameters including first position data representative of a first selected point along said elongated track and first camera direction data representative of a first camera direction selected so that said television camera provides an image of a predetermined target object when said carriage means is positioned at said first selected point, said second set of initialization parameters including second position data representative of a second selected point along said elongated track and second camera direction data representative of a second camera direction selected so that said television camera provides an image of said predetermined target object when said carriage means is positioned at said second selected point.

2. A surveillance system according to claim 1, wherein each of said sets of initialization parameters includes respective pan and tilt data.

3. A surveillance system according to claim 2, wherein said initialization means includes select means operable by a human operator for actuating a parameter storage operation and means, responsive to operation of said select means by said human operator, for detecting and storing parameter data representative of a position of said carriage means and a direction of view and a zoom condition of said television camera at a time when said select means is operated.

4. A surveillance system according to claim 1, wherein said first and second selected points define therebetween a range of positions along said rail at which said camera can be oriented to provide an image of said predetermined target object.

5. A surveillance system according to claim 4, further comprising means operatively connected to said carriage control means and to said camera control means for receiving a target acquisition signal and for responding to the received target acquisition signal by generating carriage control signals such that said carriage control means moves said carriage means to reciprocate between two predetermined points of said range of positions defined by said first and second selected points and for generating camera control signals during such reciprocating movement of said carriage means to adjust the direction of view and zoom condition of said television camera so that said television camera continuously provides an image of said predetermined target object during such reciprocating movement.

6. A surveillance system according to claim 5, wherein said two predetermined points between which said carriage means is reciprocated are said first and second selected points.

7. A surveillance system according to claim 4, further comprising target means operatively connected to said carriage control means for receiving a target acquisition signal and for responding to the received target acquisition signal by generating carriage control signals such that said carriage control means moves said carriage means to a predetermined position in said range of positions between said first and second selected points.

8. A surveillance system according to claim 7, wherein said predetermined position is at a closest point to said predetermined target object along said rail, and further comprising means for calculating, on the basis of said first and second sets of initialization parameters, said closest point and an optimum direction of view and an optimum zoom condition for causing said television camera to provide an image of said predetermined target object when said carriage means is positioned at said closest point.

9. A surveillance system according to claim 7, further comprising sensor means for providing said target acquisition signal to said target means in response to a change in a physical condition at said predetermined target object.

10. A surveillance system according to claim 7, further comprising means operatively connected to said camera control means for responding to the received target acquisition control signal by generating camera control signals based on said entered initialization parameters to adjust the direction of view and zoom condition of said television camera during movement of said carriage means in said range of positions so that said television camera continuously provides an image of said predetermined target object during such movement of said carriage means in said range of positions.

11. A surveillance system according to claim 10, further comprising:

means for calculating, based on said entered initialization parameters, and for each one of a plurality of positions between said first and second selected points, an appropriate pan angle, an appropriate tilt angle and an appropriate zoom condition for enabling said television camera to provide an image of said predetermined target object when said carriage means is positioned at the respective one of said plurality of positions; and means for storing data representative of the calculated pan and tilt angles and zoom conditions in a look up table indexed according to said plurality of positions.

12. A surveillance system according to claim 7, further comprising means operatively connected to said camera control means for responding to the received target acquisition signal by generating camera control signals in accordance with a selected one of said first and second camera direction data, if said carriage means is not positioned within said range of positions at a time when said target acquisition signal is received.

13. A surveillance system according to claim 12, wherein:

if, at said time when said target acquisition signal is received, said carriage means is positioned outside of said range of positions and closer to said first selected point than to said second selected point, then said camera control means causes the direction of view of said television camera to become said first selected camera direction in response to said received target acquisition signal; and if, at said time when said target acquisition signal is received, said carriage means is positioned outside of said range of positions and closer to said second selected point than to said first selected point, then said camera control means causes the direction of view of said television camera to become said second selected camera direction in response to said received target acquisition signal.

14. A method of initializing a rail-based closed circuit television surveillance system, the surveillance system including an elongated track positioned along a path, carriage means supported on and movable along said track for transporting a television camera along said path, carriage moving means coupled to said carriage means for selectively moving said carriage means along said track, camera control means for selectively adjusting a direction of view and a zoom condition of said television camera, and carriage control means for selectively positioning said carriage means along said track, the method comprising the steps of:

positioning said carriage means at a first selected point along said elongated track;

orienting the direction of view of said television camera in a first orientation so that said television camera provides an image of a predetermined target object at a time when said carriage means is at said first selected point;

storing a first set of initialization parameters which includes first track position data representative of said first selected point and first camera direction data representative of said first orientation of the direction of view of said television camera;

positioning said carriage means at a second selected point along said track;

orienting the direction of view of said television camera in a second orientation so that said television camera provides an image of said predetermined target object at a time when said carriage means is at said second selected point; and storing a second set of initialization parameters which includes second track position data representative of said second selected point and second camera direction data representative of said second orientation of the direction of view of said television camera.

15. An initialization method according to claim 14, further comprising the steps of:

calculating on the basis of said stored first and second sets of initialization parameters, and for each one of a plurality of positions between said first and second selected points, an appropriate pan angle, an appropriate tilt angle and an appropriate zoom condition for enabling said television camera to provide an image of said predetermined target object when said carriage means is positioned at the respective one of said plurality of positions; and storing data representative of the calculated pan and tilt angles and zoom conditions in a look up table indexed according to said plurality of positions.

16. An initialization method according to claim 14, wherein said first camera direction data includes first pan angle data and first tilt angle data and said second camera direction data includes second pan angle data and second tilt angle data.

17. An initialization method according to claim 16, further comprising the step of calculating on the basis of said stored first and second sets of initialization parameters an optimum viewpoint along said track that is closest to said target object.

18. An initialization method according to claim 17, further comprising the step of calculating, on the basis of said stored first and second sets of parameters, an optimum pan angle, an optimum tilt angle and an optimum zoom condition for enabling said television camera to provide an image of said predetermined target object when said carriage means is positioned at said optimum viewpoint.

19. An initialization method according to claim 18, wherein said step of calculating said optimum zoom condition includes calculating a distance between said predetermined target object and said optimum viewpoint.

20. A method of operating a closed circuit television surveillance system, the surveillance system including means for transporting a television camera along a path, camera control means for selectively adjusting a direction of view and a zoom condition of said television camera, and position control means for selectively positioning said camera along said path, the method comprising the steps of:

initializing said system by capturing an image of a predetermined target object by means of said television camera at respective times when said camera is at two different selected points along said path and storing initialization data indicative of the selected points and the respective directions of view of the camera used for capturing the target object image at the selected points;

calculating from the stored initialization data an optimum viewpoint along said path for capturing an image of said predetermined target object, and an optimum pan angle, an optimum tilt angle and an optimum zoom condition for capturing said image of said predetermined target object when said camera is at said optimum viewpoint;

receiving a target acquisition signal; and moving said camera to said optimum viewpoint in response to said received target acquisition signal.

21. A method according to claim 20, wherein said optimum viewpoint is between said two selected points and is closer to said predetermined target object than any other point along said path.

22. A method according to claim 20, wherein said target acquisition signal is received at a time when said camera is not between said two selected points on said path, and said moving step includes moving said camera toward a closer one of said two selected points, and further comprising the step of adjusting the direction of view of said camera, at the same time said camera is being moved towards said closer one of said two selected points, said adjusting step being carried out so that the camera has the same direction of view that was used during said initialization step to capture the image of the predetermined target object from said closer one of said two selected points.

23. A method according to claim 20, wherein said step of moving said camera to said optimum viewpoint includes moving said camera towards said optimum viewpoint along a range of positions between said two selected points, and further comprising the step of adjusting the direction of view and zoom condition of said camera during such movement of said camera along said range of positions so that said camera continuously provides an image of said predetermined target object during such movement of said camera in said range of positions.

24. A method according to claim 23, wherein said initializing step includes calculating on the basis of said stored initialization data, and for each one of a plurality of positions between said two selected points, an appropriate pan angle, an appropriate tilt angle and an appropriate zoom condition for enabling said television camera to provide an image of said predetermined target object when said camera is positioned at the respective one of said plurality of positions, and storing data representative of the calculated pan and tilt angles and zoom conditions in a look up table indexed according to said plurality of positions.

25. A method according to claim 20, further comprising the step of moving said camera according to a predetermined pattern in response to said received target acquisition signal.

26. A method according to claim 25, further comprising the step of continuously adjusting the direction of view of said camera during said movement of said camera according to said predetermined pattern so that said direction of view remains oriented towards said target object during said movement of said camera.

27. A method according to claim 26, wherein said movement of said camera according to said predetermined pattern includes reciprocating said camera between two predetermined points.

28. A method according to claim 27, wherein said two predetermined points between which said camera is reciprocated are said two selected points.

* * * * *

UNITED STATES PATENT AND TRADEMARK OFFICE

CERTIFICATE OF CORRECTION

PATENT NO. : 5,526,041

DATED : June 11, 1996

INVENTOR(S): Terry L. Glatt

It is certified that error appears in the above-identified patent and that said Letters Patent is hereby corrected as shown below:

Col. 2, line 47, delete "-".

Col. 8, line 56, change "$\theta_z$" to -- $\alpha_z$ --.

Col. 9, line 5, change "αz" to -- $\alpha_z$ --.

Col. 10, line 16, change "Obtain" to -- obtain --.

Signed and Sealed this

Fifteenth Day of April, 1997

Bruce Lehman

*Attest:*

BRUCE LEHMAN

*Attesting Officer*

*Commissioner of Patents and Trademarks*